US008028479B2

(12) United States Patent
Milburn

(10) Patent No.: US 8,028,479 B2
(45) Date of Patent: Oct. 4, 2011

(54) INTERLOCKING STRUCTURAL GLAZING PANELS

(75) Inventor: Douglas I. Milburn, Dunrobin (CA)

(73) Assignee: Advanced Glazing Technologies Limited (AGTL), Sydney, NS (CA)

( * ) Notice: Subject to any disclaimer, the term of this patent is extended or adjusted under 35 U.S.C. 154(b) by 0 days.

(21) Appl. No.: 12/190,832

(22) Filed: Aug. 13, 2008

(65) Prior Publication Data

US 2009/0064608 A1 Mar. 12, 2009

Related U.S. Application Data

(60) Provisional application No. 60/956,067, filed on Aug. 15, 2007.

(51) Int. Cl.
*E06B 3/00* (2006.01)
*E06B 3/24* (2006.01)

(52) U.S. Cl. ..... 52/204.593; 521/786.11

(58) Field of Classification Search ..... 52/204.5, 52/209, 204.593, 204.6, 235, 578, 582.1, 52/786.1, 786.11, 786.13, 794.1, 745.06, 52/745.09

See application file for complete search history.

(56) References Cited

U.S. PATENT DOCUMENTS 3,680,276 A * 8/1972 Wright et al. ..... 2/204.593
4,120,127 A * 10/1978 Hubbard ..... 52/172
4,387,542 A 6/1983 Wehr
4,471,584 A * 9/1984 Dietrich ..... 52/14
5,007,215 A * 4/1991 Minter ..... 52/92.3
5,394,664 A * 3/1995 Nowell ..... 52/200
5,653,073 A 8/1997 Palmer
6,055,782 A 5/2000 Morton et al.
6,055,783 A 5/2000 Guhl et al.
6,088,978 A * 7/2000 Satterwhite ..... 52/200
6,253,511 B1 7/2001 Boyer
6,286,288 B1 9/2001 France
6,401,428 B1 6/2002 Glover et al.
6,463,706 B1 10/2002 Guhl et al.
6,536,182 B2 3/2003 France
6,627,128 B1 9/2003 Boyer
6,662,523 B2 12/2003 Hornung et al.

(Continued)

FOREIGN PATENT DOCUMENTS

DE 2532633 B1 12/1976

(Continued)

OTHER PUBLICATIONS

Galvamet America Corporation http://www.galvamet.com/.

(Continued)

*Primary Examiner* — Brian Glessner
*Assistant Examiner* — Beth Stephan
(74) *Attorney, Agent, or Firm* — Marks & Clerk

(57) ABSTRACT

Disclosed is an interlocking glazing panel comprising a pair of transparent or translucent lites, and rigid structural spacer located between, and firmly attached to, said lites to define a gap therebetween, said rigid structural spacer extending around at least part of the periphery of said glazing unit and having over at least a portion thereof an interlocking profile to provide a firm interlocking connection to another interlocking panel having a complementary like interlocking profile, wherein said glazing panel can be inserted as a structural member in a wall or roof constructed of interlocking panels.

12 Claims, 10 Drawing Sheets

U.S. PATENT DOCUMENTS

| | | | | |
|---|---|---|---|---|
| 6,699,558 | B1 * | 3/2004 | Milburn | 428/73 |
| 6,699,559 | B1 | 3/2004 | Milburn | |
| 6,823,643 | B2 | 11/2004 | France | |
| 6,868,648 | B2 | 3/2005 | Glover et al. | |
| 6,928,776 | B2 * | 8/2005 | Hornung | 52/204.62 |
| 6,968,659 | B2 | 11/2005 | Boyer | |
| 6,974,518 | B2 * | 12/2005 | Hornung et al. | 156/109 |
| 7,100,343 | B2 | 9/2006 | France | |
| 7,124,543 | B2 | 10/2006 | Chubb | |
| 7,204,902 | B2 | 4/2007 | Wang et al. | |
| 2003/0126813 | A1 * | 7/2003 | Leytes et al. | 52/235 |
| 2005/0144863 | A1 * | 7/2005 | Collins | 52/204.5 |

FOREIGN PATENT DOCUMENTS

WO PCT/GB94/00908 11/1994

OTHER PUBLICATIONS

Insulated Panel Systems (IPS) http://www.insulated-panels.com/.
Benchmark Architectural Systems Inc. http://www.benchmarkpanels.com/.
Metecno ASI http://www.alumashield.com/.
Metecno API http://www.apipanel.com/.
Coldmatic Building Systems http://www.coldmatic.com.
Kingspan Insulated Panels http://www.kingspanpanels.com/.
Centria http://www.centria.com/default.aspx.
Metl-Span http://www.metlspan.com/.
Vicwest http://www.vicwest.com/.
Zero-Loc http://www.zeroloc.com/.
http://www.iacsc.org/iacsc/search.asp.
Search Report from EP08162411.6.

* cited by examiner

COMPARISON OF DEFLECTS PTS. 1A3 AND 1B1

SERIES #7
21-APR-07 PANELIZED TESTING: SUCTION OF CELLS IN 1" OF WATER INCREMENTS FROM 8" TO 12" OF WATER
(WITH 3 CONFIRMATION READINGS AT 1",4" & 7")

| | 1 | 4 | 7 | 8 | 9 | 10 | 11 | 12 |
|---|---|---|---|---|---|---|---|---|
| 1A3 | 0.024 | 0.096 | 0.163 | 0.184 | 0.210 | 0.233 | 0.260 | 0.286 |
| 1B1 | 0.028 | 0.109 | 0.184 | 0.208 | 0.237 | 0.262 | 0.293 | 0.322 |

COMPARISON OF DEFLECTION PTS. 1A3 AND 1B1

INTERLOCKING STRUCTURAL GLAZING PANELS

CROSS-REFERENCE TO RELATED APPLICATION

This application claims the benefit of U.S. Provisional Application No. 60/956,067 filed Aug. 15, 2007, incorporated by reference herein.

FIELD OF THE INVENTION

This invention relates to the field of building construction.

BACKGROUND OF THE INVENTION

Large modern buildings are generally constructed by building a concrete and steel frame structure, and then installing panels to define the interior and exterior walls. In many cases, the panels are made of architectural glass installed on the building by a suitable framing system. Glass panels are desirable because of the need to introduce as much natural light as possible into the building, making for a more pleasing environment and also helping to reduce energy costs. More recently, the advantages of light-diffusing translucent panels have been realized. Conventional transparent windows will transmit the sun's rays directly into the building, giving rise to excessive contrast. Light diffusing panels will diffuse the light, giving the impression of a light and airy room without excessive contrast. In a sense, such panels act as passive diffuse light sources in the building in a similar manner to fluorescent panels, but with the source of the light being natural instead of artificial.

There are two kinds of wall structure: so-called curtain walls and structural walls. Curtain walls are not self-supporting, and rely on an external rigid frame to hold the panels in place. Such walls are typically found in shop windows. In curtain walls, since the panels do not bear any load, they are relatively easy to make, and traditional double glazing is often sufficient. Structural walls, on the other hand, are self-supporting, and are typically made as an interlocking structure that can be fitted together. Such walls are not made of glass because of the excessive loads that would be imposed on the glass panels, especially when the need to provide adequate thermal insulation is taken into account. In the case of double-glazed windows, if the gap between the panes, known as lites, is too great condensation problems arise because it is very difficult to maintain a hermetic seal in the real world environment; if it is too small, the windows cannot bear the load. Such windows are typically made in a conventional manner by providing a window frame and inserting the window panels within the frame.

It is known to install insulated core, rigid skinned on the exterior of buildings as cladding, in the interior of buildings as partitions, and on the roofs of buildings both as (a) exterior cladding and (b) interior partition, and (c) interior and (d) exterior freezer panels, thus achieving a weather tight, durable, insulated, efficient, pre-finished, easily installed, appealing building envelope, freezer panel or partition.

It is also known that rigid cladding panels of metal, plastic, wood or composite materials can also be installed as stated, with or without insulation, and with or without interior rigid liner panels. These panels may be either opaque or translucent. It is also known that daylighting products can be installed into rigid exterior panel systems by installing structural framing and then installing framed window systems. It is further known that conventional framed window and louver systems can be installed into insulated core rigid skinned panel cladding systems through the use of purpose made adaptor profile frames to allow the insertion of said conventional window systems and louver systems into the panel systems. Solera™ panels by Advanced Glazings Limited provide high performance insulated translucent glazing units with the elegance, versatility and durability that come only with glass.

Examples of wall panels and glazing systems are found in the following U.S. Pat. No. 4,387,542, Integrated window and wall system; U.S. Pat. No. 5,653,073, Fenestration and insulating construction; U.S. Pat. No. 6,055,782, Extruded plastic window frame; U.S. Pat. No. 6,055,783, Unitary insulated glass unit; U.S. Pat. No. 6,286,288, Integrated multi-pane window unit; U.S. Pat. No. 6,401,428, Fenestration sealed frame insulating; U.S. Pat. No. 6,463,706, Unitary insulating glass unit; U.S. Pat. No. 6,536,182, Integrated multi-pane window unit; U.S. Pat. No. 6,662,523, Insulating glass sash assemblies; U.S. Pat. No. 6,823,643, Integrated multiple sash window unit; U.S. Pat. No. 6,868,648, Fenestration sealed frame insulating; U.S. Pat. No. 6,928,776, Window sash frame with hinged; U.S. Pat. No. 6,974,518, Method for fabricating an integrated; U.S. Pat. No. 7,100,343, Window sash glazing unit; U.S. Pat. No. 7,124,543, Window frame; U.S. Pat. No. 7,204,902, Low temperature press process; U.S. Pat. No. 6,253,511, Composite joinery; U.S. Pat. No. 6,627,128, Composite joinery; U.S. Pat. No. 6,968,659, Composite joinery.

None of these systems permits the incorporation of a glazing unit into a structural wall and which at the same time provides adequate thermal insulation.

SUMMARY OF THE INVENTION

The present invention provides a glazing panel that can inserted into a structural wall without the need for an additional framing structure. Surprising, the applicants have found that the structure in accordance with the invention has sufficient structural integrity to be assembled into a wall or roof structure with other interlocking panels, or similar construction panels without glazing, and having, for example, a foam core.

According to the present invention there is provided a glazing unit comprising a pair of transparent or translucent lites, and a rigid structural spacer located between, and firmly attached to, said lites to define a gap therebetween, said rigid structural spacer extending around at least part of the periphery of said glazing unit and having over at least a portion thereof an interlocking profile for providing a firm interlocking connection to another like glazing unit. Thus a rigid structural spacer in accordance with the teachings of this invention serves to provide a gap between the lites and serve as a structural element that can take a load. Some embodiments of the spacer also provides an interlocking profile.

The lites are preferably attached to the spacer frame with a structural adhesive, such as structural silicone adhesive, but in the alternative mechanical connectors, such as bolts, brackets or other fasteners could be employed, although it is preferred not to make holes in the glass lites.

The rigid structural spacer is typically made of a metal such as aluminum, but other materials such as galvanized steel, stainless steel, and fiber glass can be used. The gap between the lites, in the case of light diffusing unit, can suitably be filled with a core material, such as honeycomb insulation in associated with fiber glass veils.

The gap between the lites should preferably be at least 2" to provide sufficient structural integrity to the glazing unit. In such a case it may be necessary to vent the unit. For this purpose, a small hole open to the outside is drilled through the exterior lite. The hole has a diameter of 0.010-0.050", typically 0.020". This allows for expansion and contraction with some degree of hysteresis.

It will be understood that the term "glazing units" as used throughout is intended in a broader sense, encompassing for example both window-type panels and wall-type panels. Glazing units in accordance with the invention can be installed as daylighting or vision units into any number of existing or future profiles of insulated core, rigid skinned pre-manufactured panels by various manufacturers and rigid cladding panels with or without insulation and with or without rigid interior liner panels. The panel can be an exterior cladding panel, an interior partition panel, an interior freezer panel, an exterior freezer panel an interior roof panel, an interior freezer roof panel, an exterior roof panel, a vision panel.

In embodiments of the invention, the glazing units are installed by means of providing a compatible interface profile at the bottom, sides and/or top of the daylighting panel such that a smooth, flush (or recessed or protruding), frameless (or framed) installation is achieved, resulting in clean sight lines and an architecturally pleasing appearance.

The glazing units of the invention can be installed on horizontal, or vertical, or sloped axes. The installation is simple, economical and easily accomplished.

The novel method of the present invention involves the integration of the daylighting or vision glass unit into the interlocking and/or interfacing assembly profiles of the insulated core rigid skinned pre-manufactured panels, eliminating the need for any additional structural framing beyond that required for the insulated core rigid skinned panels, and the need for any type of widow type framing whatsoever.

Embodiments of the invention eliminate the need for labor to install additional structural framing as well as the labor to install window type framing. Embodiments of the invention also eliminate the need for any type of window adaptor interface assembly and any required additional structural framing, as well as the need for labor to install said adaptors and required structural framing.

The panels can interface with each other. One or more of the panels can interface with an insulated core rigid skinned pre-manufactured panels of existing or future profile. Alternatively, simple rigid cladding can be installed on the structure instead of the insulated core, rigid skinned pre-manufactured panels.

The structure may also include field assembled cladding and insulation, which can be in the form of a field assembled rigid cladding, insulation and rigid interior liner panel.

Other aspects of the invention include a method of a daylighting panel by providing a transparent or translucent face panel, providing a structural panel spacer with interlocking or interfacing profiles, providing spacing of the face or interior panel from structural member contact, providing a structural adhesive or mechanical device to bond the spacer to the panel, and providing a transparent or translucent interior panel.

The invention also provides a method for installing a daylighting panel by providing interlocking or interfacing surfaces appropriate to the insulated core rigid skinned panel allowing simple installation using same method as existing panel, providing a surface area on one or more faces of the structural spacer to allow mechanical attachment of the invention to the structural framing of the building or other structure to be compatible with the mechanical attachment of the existing or future profiles of insulated core rigid skinned pre-manufactured panel, and providing a structural spacer with or without exposed edge protection and or perimeter flange.

In the case of rigid cladding alone, with insulation, or with insulation and rigid liner panel, the invention provides a profile matching or compatible perimeter flange to allow direct attachment to the rigid cladding and or the rigid liner panel.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE DISCLOSED EMBODIMENTS

Figure 1:
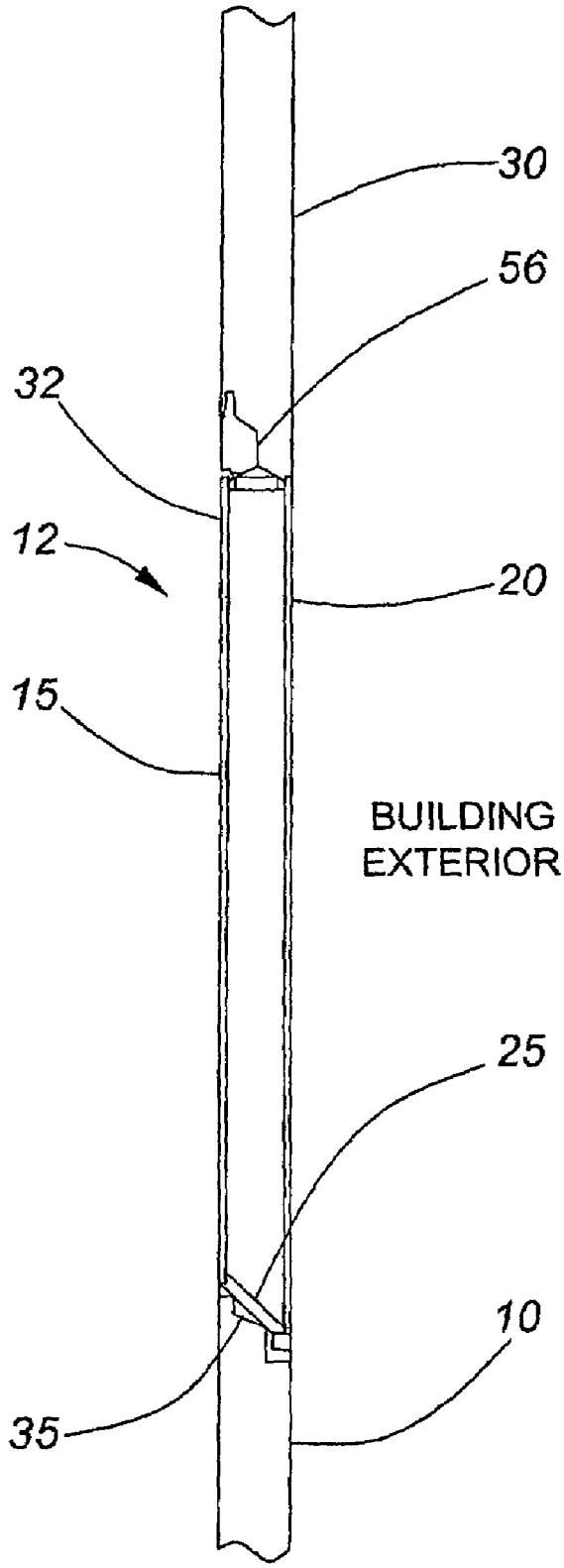
FIG. 1 illustrates an end section of a glazing panel in accordance with the teachings of this invention.

Referring to FIG. 1, the present invention provides a glazing panel or unit 10 that can be used to from a structural wall 12 without the need for an additional framing structure. FIG. 1 illustrates an end section of a horizontal installation; it will be appreciated that one skilled in the art will understand that a vertical installation is similar. Broadly, according to the present invention there is provided a glazing unit 10 comprising a pair of transparent or translucent lites 15, 20, and a rigid structural spacer 25 located between, and firmly attached to, said lites 15, 20 to define a gap 30 therebetween, said rigid structural spacer 25 extending around at least part of the periphery of said glazing unit 10 and having over at least a portion thereof an interlocking profile 35 for providing a firm interlocking connection to another like glazing unit (not shown). The glazing unit can be of any suitable thickness, 3" being exemplary. The length of the unit 10 can be any suitable length, 36"being exemplary. It will be understood that in this context the word interlocking implies any kind of engagement that permits the panels to be assembled into a structural unit. For example, a tongue-and-groove arrangement is considered being interlocked.

In one embodiment, panels 10 in accordance with the teachings of the invention are capable of interfacing with themselves on all sides. The interlock/interface can also occur with the adjacent daylighting or vision panels 32. In use, in one embodiment, the interlocking panels 10 are like glazing panels. In another embodiment, the interlocking panels are structural non-glazed walls or roof panels.

The panel 10 can be an exterior cladding panel, an interior partition panel, an interior freezer panel, an exterior freezer panel an interior roof panel, an interior freezer roof panel, an exterior roof panel, a vision panel. The panels 10 can interface with each other. One or more of the panels can interface with an insulated core rigid skinned pre-manufactured panels of existing or future profile.

Alternatively, simple rigid cladding can be installed on the structure instead of the insulated core, rigid skinned pre-manufactured panels. Preferably, the panel is rectangular, and separate said rigid structural spacers are provided for the upper and lower edges as described in detail below.

Figure 2A:
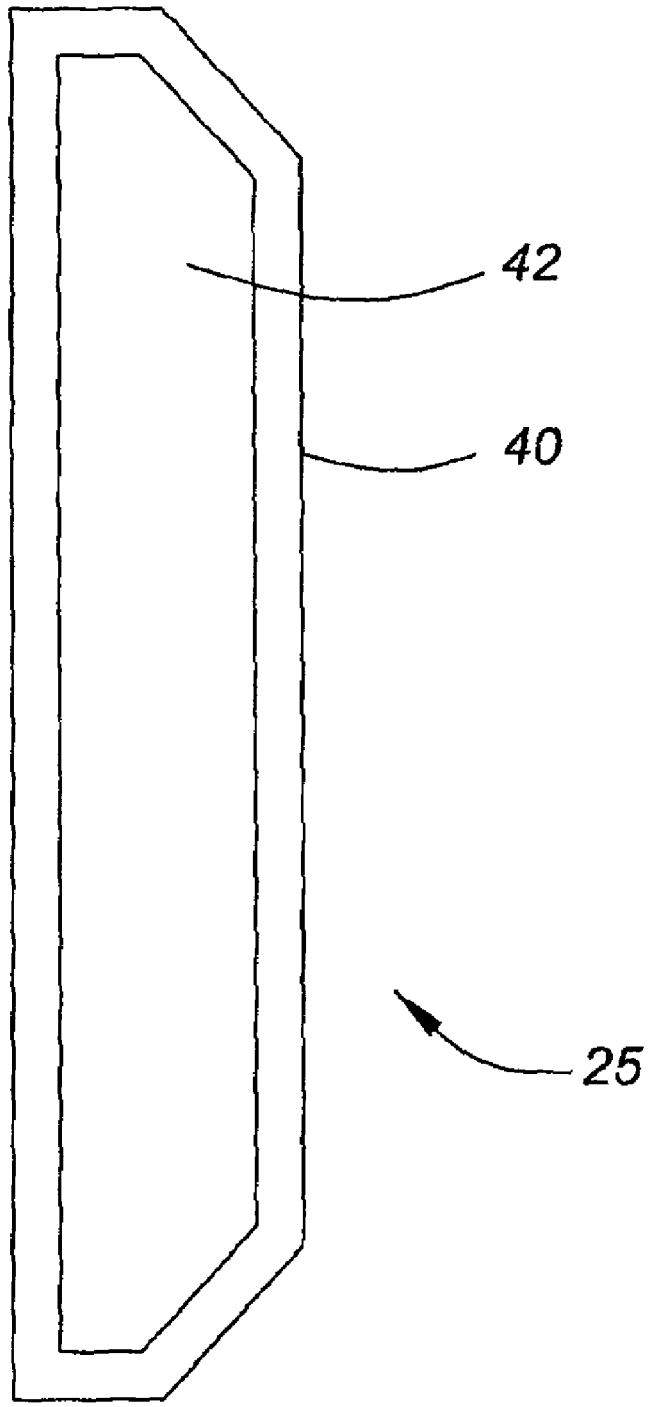
FIGS. 2A 2B, 3A and 3B illustrate embodiments of a rigid structural spacer in accordance with the teachings of this invention than can be used in the glazing panel of FIG. 1.
Figure 2B:
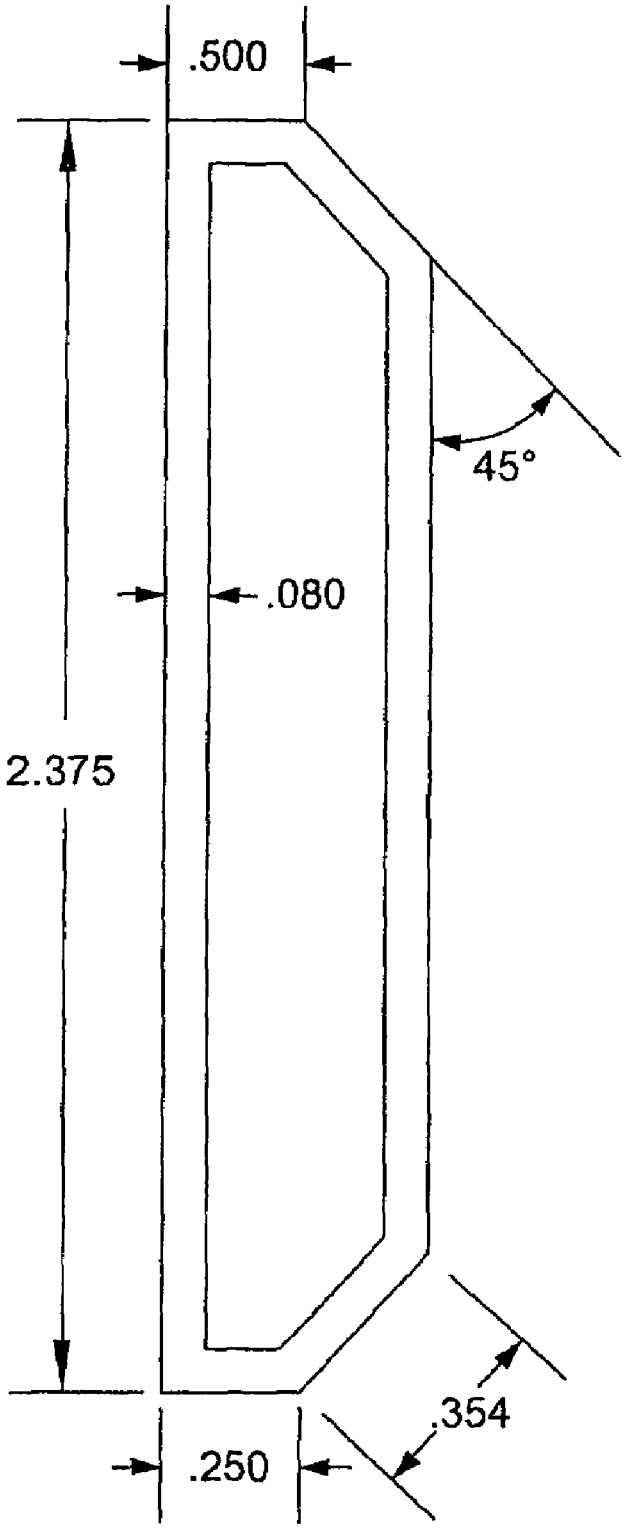
Figure 3A:
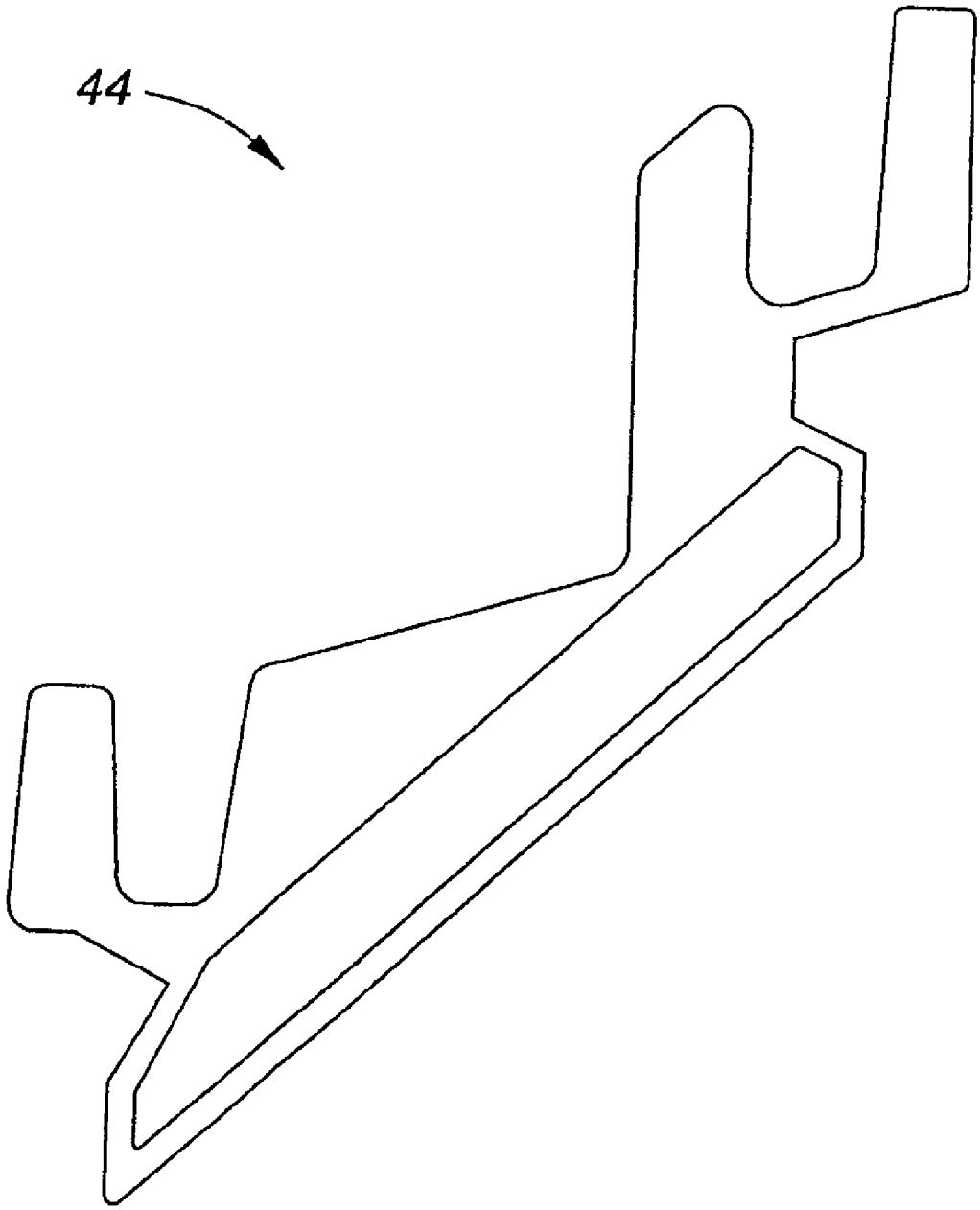

Referring to FIGS. 2A, 2B, 3A and 3B, embodiments of the invention include a structural spacer 25, having a suitable thickness, installed at the perimeter of the insulating of a daylighting or vision unit 10. In the embodiment of FIG. 2A, an interlocking mechanism is not shown. The embodiment of FIG. 3A illustrates a profile compatible with the interlocking or interfacing condition with the corresponding surfaces. For each embodiment, adjacent surfaces can be rigid skinned pre-manufactured panels or rigid cladding panel, with or without insulation, with or without interior rigid liner panel. An exemplary thickness is 0.08". Preferably as shown in the embodiment of FIG. 3A, the rigid structural spacer 25 has an irregular profile 40 with a box section 42 between said lites and a protruding tongue 44 for interlocking with a corresponding recess in an adjacent panel (not shown). However any suitable interlocking profile could be used.

Figure 3B:
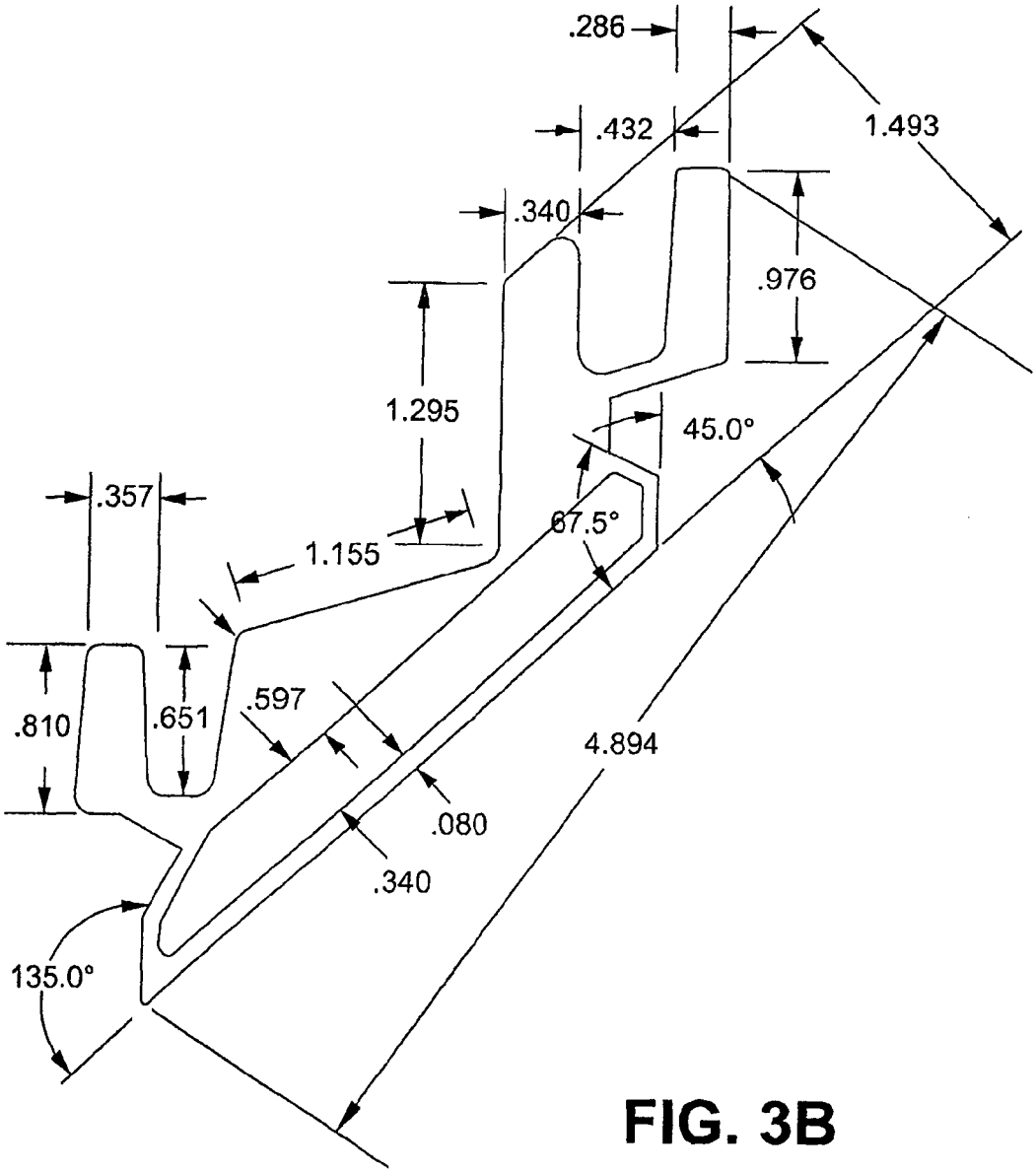

FIG. 2B illustrates exemplary dimensions of the embodiment of FIG. 2A while FIG. 3B illustrates exemplary dimensions of the embodiment of FIG. 3A.

The rigid structural spacer 25 is typically made of a metal such as aluminum, but other materials such as galvanized steel, stainless steel, and fiber glass, composite plastic, metal reinforced plastic or other material for the specific application can be used. The material can be thermally broken or not.

The structural spacer should be installed between two layers or lites made of glass, or polycarbonate or acrylic or fiber reinforced composite materials or other material appropriate to the scope of the specific application using structural adhesive and a moisture block material as described in detail below.

The structural spacer may or may not have exposed edges or not to provide edge protection for the face and interior panels and spacing away from structural framing as required or not.

The gap 30 between the lites, in the case of light diffusing unit, can suitably be filled with a core material, such as honeycomb insulation in associated with fiber glass veils as described in Applicant's issued U.S. Pat. No. 6,699,559, issued Mar. 2, 2004, the contents of which are herein incorporated by reference. When a veil is used between the honeycomb insulation, at least one of the lights may diffuse light passing through the panel.

The gap between the lites should preferably be at least 2" to provide sufficient structural integrity to the glazing unit. In such a case it may be necessary to vent the unit. For this purpose, a small hole open to the outside is drilled through the exterior lite. The hole has a diameter of 0.010-0.050", typically 0.020". This allows for expansion and contraction with some degree of hysteresis.

Figure 4:
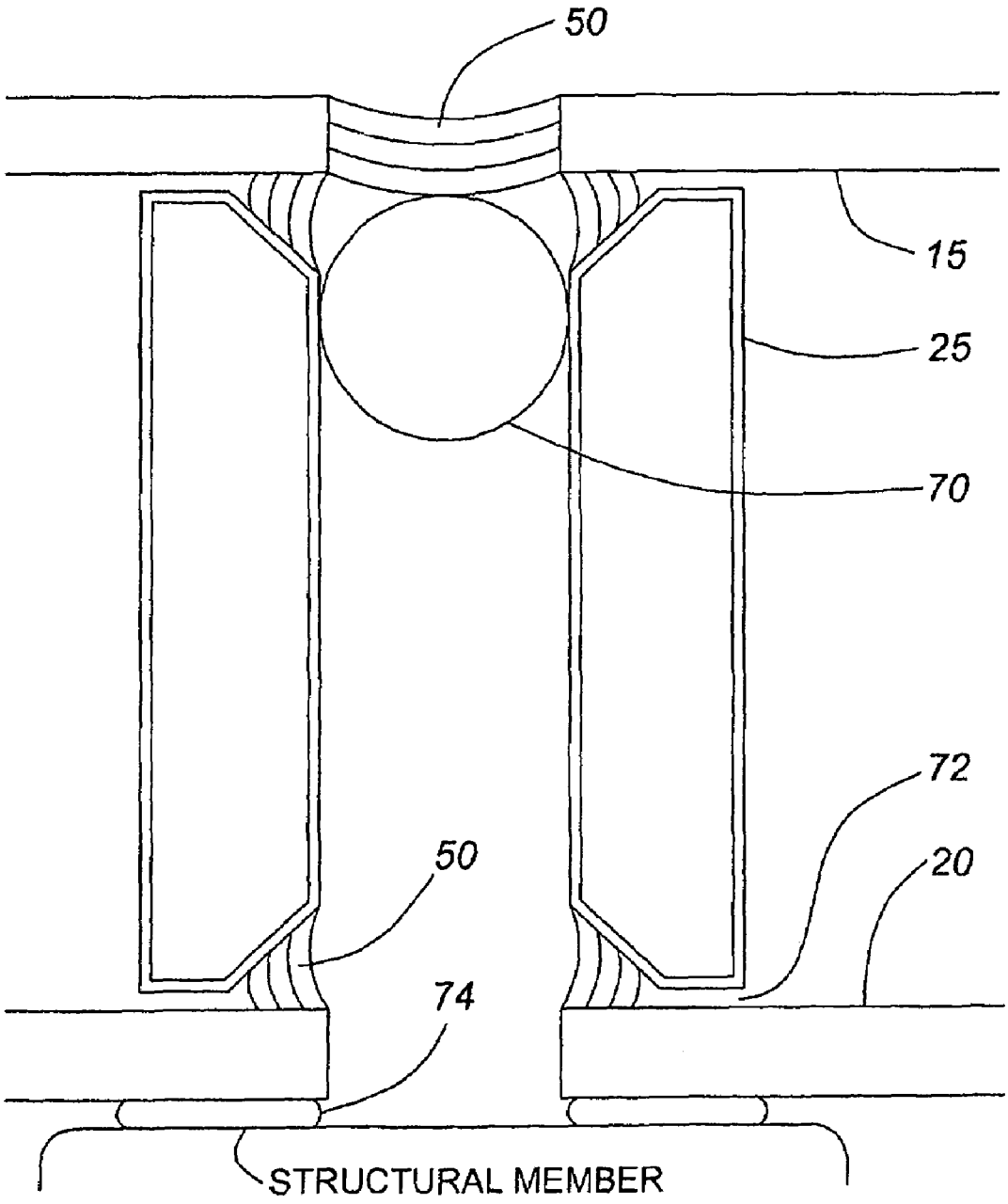
FIG. 4 illustrates a vertical joint plan detail in accordance with the teachings of this invention.

FIG. 4 illustrates a vertical joint plan detail in accordance with the teachings of this invention. The lites 15, 20 are preferably attached to the spacer frame 25 with a structural adhesive 50, such as structural silicone adhesive, but in the alternative mechanical connectors, such as bolts, brackets or other fasteners could be employed, although it is preferred not to make holes in the case of glass lites. In the embodiment shown between two sets of units, there is a foam backer rod 70. A moisture banier 72 is adhered using caulk 74 to form a vapour barrier. A typical width between the two spacers is 0.5". It should be noted that the spacer used is that of FIG. 2A and that an interlocking feature is not illustrated in this figure but could be incorporated as needed.

Figure 5:
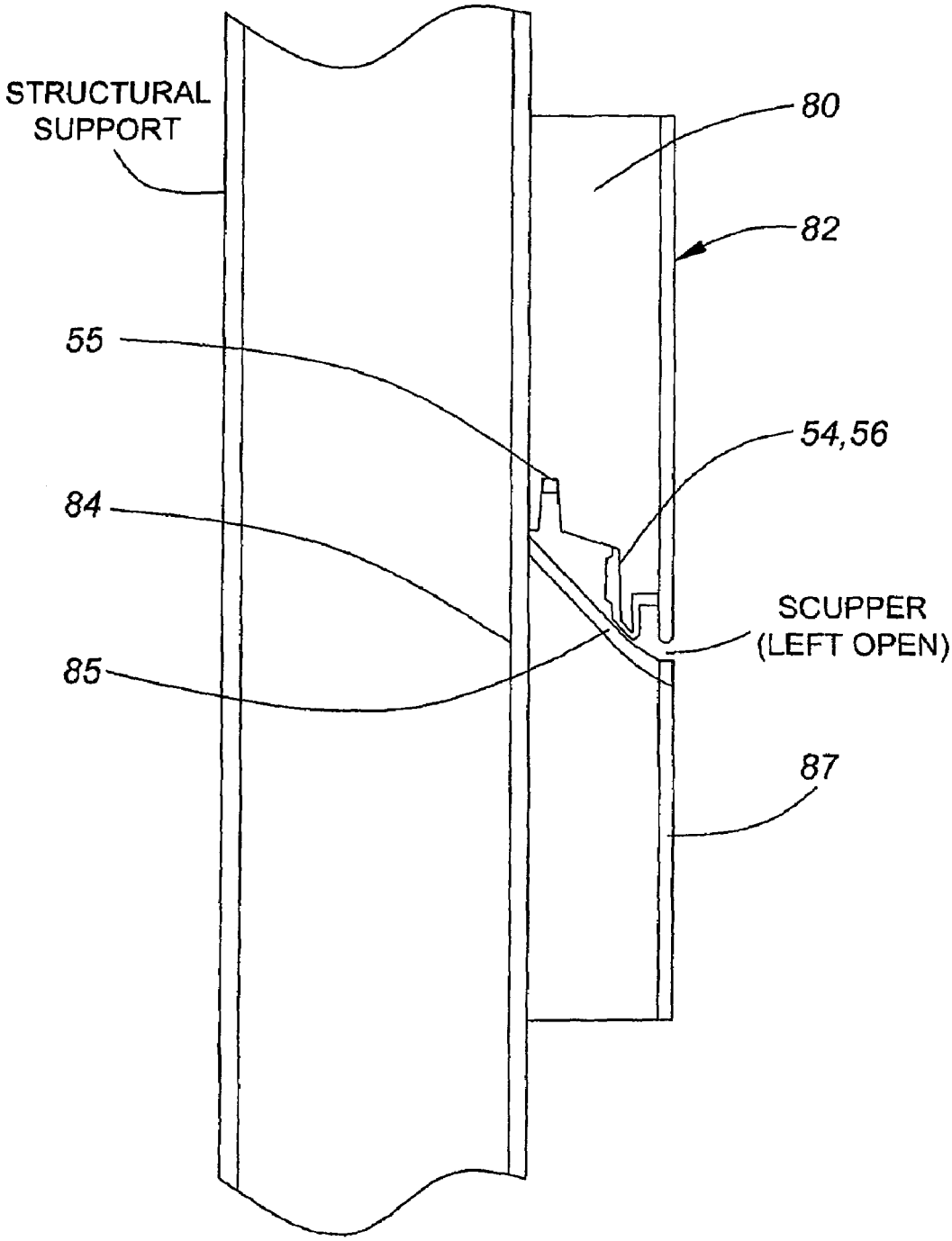
FIG. 5 illustrates a foam panel installation in accordance with the teachings of this invention.
Figure 6:
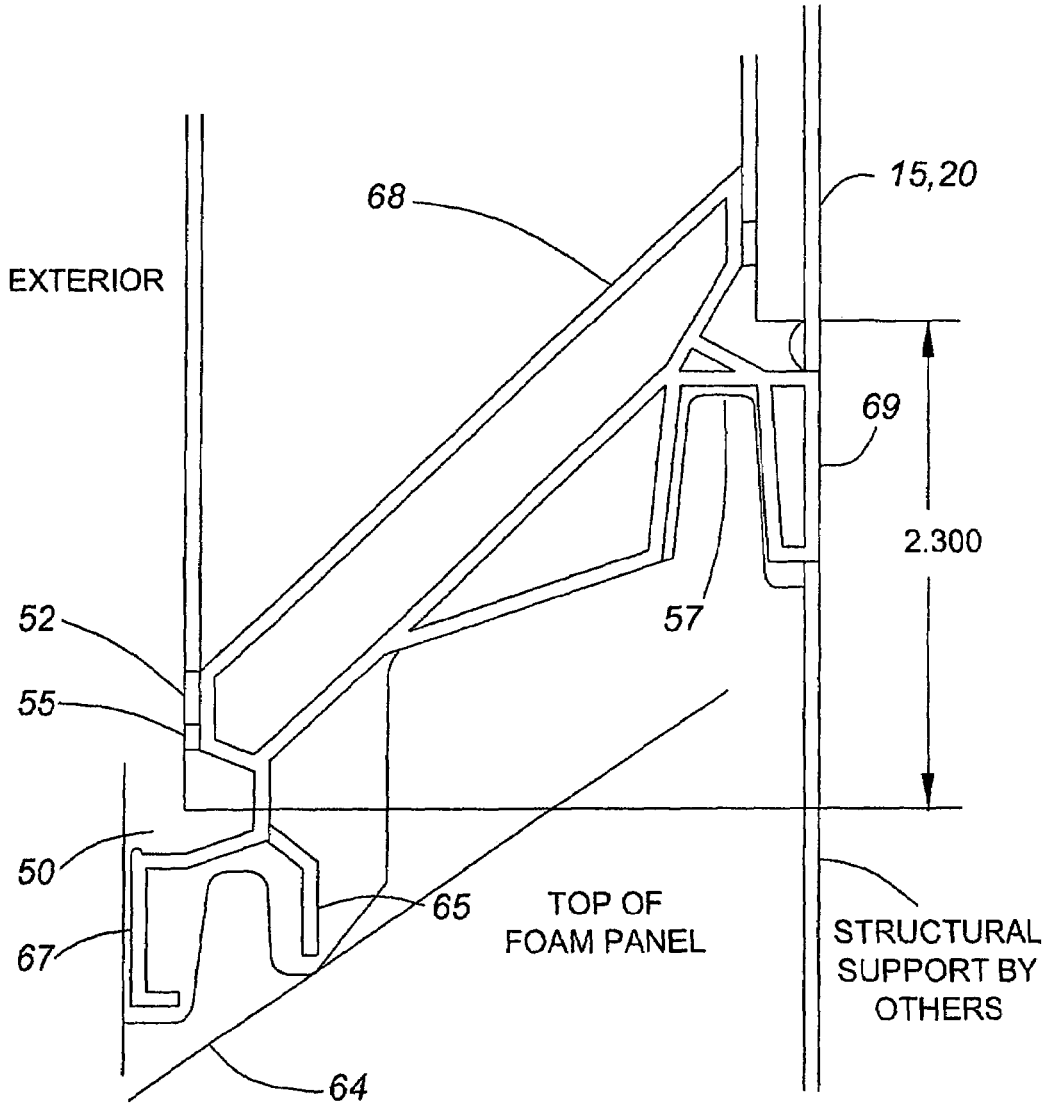
FIG. 6 illustrates a top extrusion in accordance with the teachings of this invention.
Figure 7:
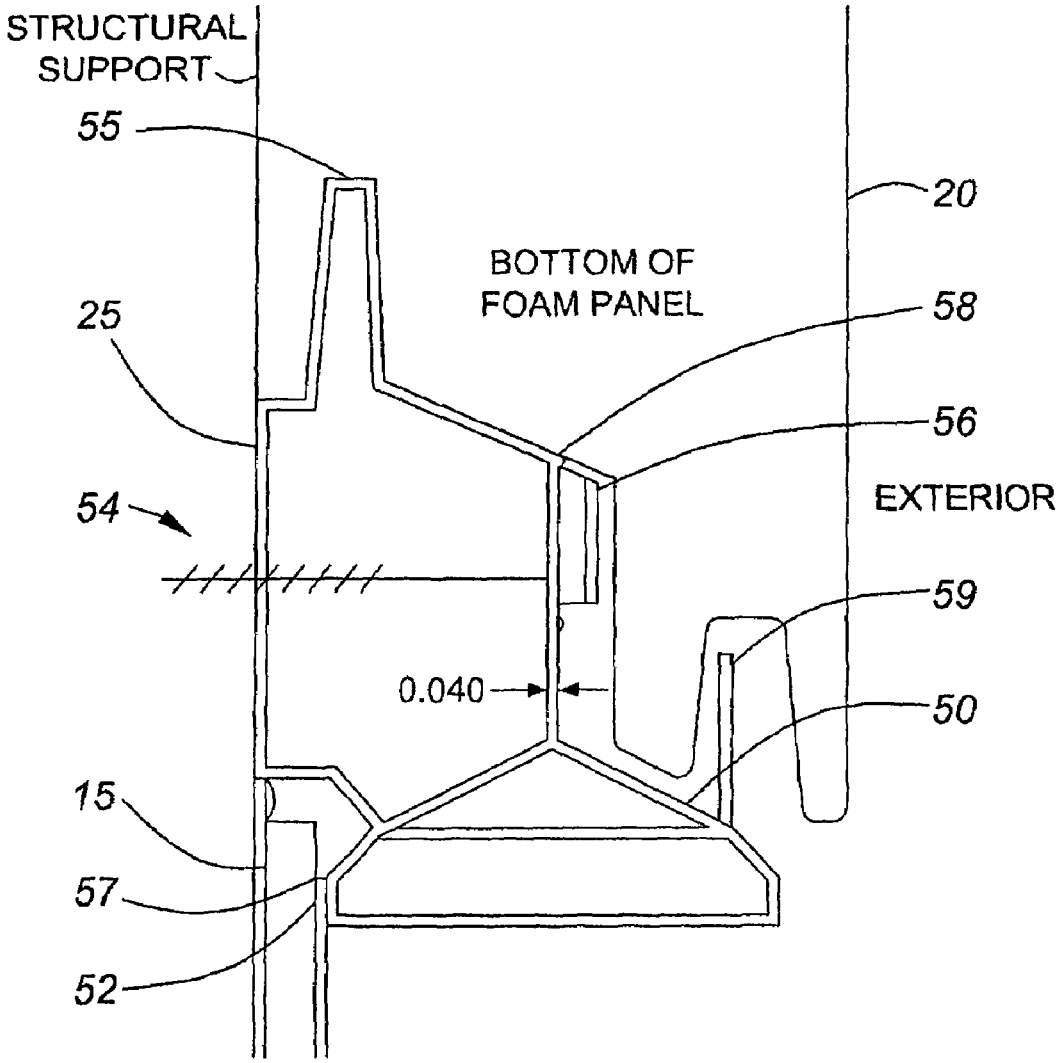
FIG. 7 illustrates a bottom extrusion in accordance with the teachings of this invention.

FIGS. 5, 6 and 7 illustrate a typical foam panel installation. In embodiments of the invention, the glazing units are installed by means of providing a compatible interface profile at the bottom, sides and top of the daylighting panel such that a smooth, flush (or recessed or protruding), frameless (or framed) installation is achieved, resulting in clean sight lines and an architecturally pleasing appearance. The glazing units of the invention can be installed on horizontal, or vertical, or sloped axes. The installation is simple, economical and easily accomplished.

FIG. 6 illustrates a typical top spacer without thermal breaks for clarity. The spacer 25 is placed between glazing panels 15, 20 using structural silicone adhesive 50. Preferably the thickness is ¼ minimum. There is also glazing tape 52, and a structural fastener 54. Butyl is used at two locations 55, 57. A washer plate 56 and washer plate locator boss 58 are also used. Optionally, there may be a pressure equalization plate 59.

FIG. 7 illustrates a typical bottom spacer without thermal breaks for clarity. The spacer 25 is placed between glazing panels 15, 20 using structural silicone adhesive 50. There is also glazing tape 52, and a structural fastener 54. Butyl is used at two locations 55, 57. A washer plate 56 and caulk (ending at caulking line 64) are also used. Optionally, there may be a baffle plate 65. Standoff and edge protection are located at either side 67, 69. Note the profile 68 of the spacer is preferably shaped to match 45 degrees.

FIG. 5 illustrates a insulated foam panel horizontal application section at a vertical joint. Insulating foam core 80 is located between an exterior metal skin 82 and interior metal liner. Caulking is used at the thru-wall line 85 and the exterior foam back 87 (for vertical joints only).

Glazing units in accordance with the invention can be installed as daylighting or vision units into any number of existing or future profiles of insulated core, rigid skinned pre-manufactured panels by various manufacturers and rigid cladding panels with or without insulation and with or without rigid interior liner panels.

The novel method of the present invention involves the integration of the daylighting or vision glass unit into the interlocking and/or interfacing assembly profiles of the insulated core rigid skinned pre-manufactured panels, eliminating the need for any additional structural framing beyond that required for the insulated core rigid skinned panels, and the need for any type of widow type framing whatsoever.

Embodiments of the invention eliminate the need for labor to install additional structural framing as well as the labor to install window type framing. Embodiments of the invention also eliminate the need for any type of window adaptor interface assembly and any required additional structural framing, as well as the need for labor to install said adaptors and required structural framing.

The structure may also include field assembled cladding and insulation, which can be in the form of a field assembled rigid cladding, insulation and rigid interior liner panel. Surprising, the applicants have found that the structure in accordance with the invention has sufficient structural integrity to be assembled into a wall or roof structure with like interlocking panels, or similar construction panels without glazing, and having, for example, a foam core.

Figure 8:
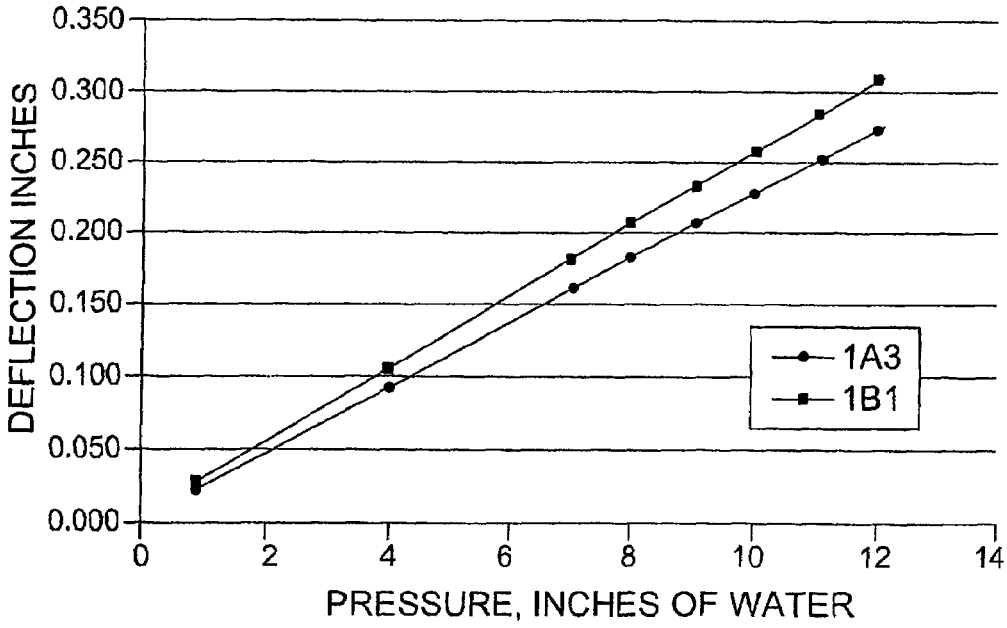
FIG. 8 shows the results of deflection tests on the panels in accordance with embodiments of the invention.

FIG. 8 illustrates the results of testing done on the assembled unit. The panelized testing comprised suction of cells in 1" of water increments from 8" to 12" of water, which 3 confirmation readings at 1", 4" and 7". It can be seen that even at 12" of water, the deflection was less than 0.350".

The disclosed panels avoid the labor and materials associated with conventional window and daylighting installation in pre-manufactured insulated core rigid skinned panel applications. It also eliminates the need for additional structural framing and the associated labor for the installation of said framing as is required with previously existing window and daylighting installation methods.

Embodiments of the present invention also eliminate the material and labor costs of a conventional window framing system, as well as the material and labor costs associated with any adaptor system involved in existing window and louver integration adaptors.

Numerous modifications may be made without departing from the spirit and scope of the invention as defined in the appended claims.

What is claimed is:

1. A self-supported, frameless glazing panel, comprising:

a pair of transparent or translucent glass lites spaced apart from one another to define a gap therebetween;

a rigid structural spacer located in the gap and attached to said lites, said rigid structural spacer extending around at least a portion of the periphery of said glass lites to form a glazing panel;

an exposed surface on the rigid structural spacer; and an interlocking profile on the exposed surface of the rigid structural spacer, the interlocking profile of the spacer of the self-supported glazing panel being able to mate with a complementary interlocking profile of a second structural spacer such that the glazing panel is self-supported;

the rigid structural spacer having a sufficient thickness to provide structural integrity to the glazing panel to form the self-supported, frameless glazing panel which can be inserted as a structural member in a wall or roof without use of a separate structural frame.

2. The glazing unit of claim 1, wherein the rigid structural spacer is 2" thick to provide structural integrity to the glazing unit.

3. The glazing panel of claim 2, wherein said another interlocking panel is a like glazing panel.

4. The glazing panel of claim 2, wherein said another interlocking panel is a structural non-glazed wall or roof panel.

5. The glazing panel of claim 2, wherein said rigid structural spacer has an irregular profile with a box section between said lites and a protruding tongue for interlocking with a corresponding recess in an adjacent panel.

6. The glazing panel of claim 2, wherein said panel is rectangular, and separate said rigid structural spacers are provided for the upper and lower edges.

7. The glazing panel of claim 2, wherein said rigid structural spacer is bonded to said lites with structural adhesive.

8. The glazing panel of claim 2, wherein a venting hole having a diameter in the range 0.0 10 to 0.050 inches is provided through one of said lites into a gap between said panels.

9. The glazing unit of claim 1, further comprising a honeycomb insulation inserted between the lites.

10. The glazing unit of claim 9, further comprising a veil between the honeycomb insulation and at least one of the lights to diffuse light passing through the panel.

11. The glazing unit of claim 2, further comprising a protruding spacing structure on said rigid structural spacer to hold the lites away from a main body portion of said rigid structural spacer.

12. A method of manufacturing a self-supported, frameless glazing panel which can be inserted as a structural member in a wall or roof without use of a separate structural frame, the method comprising:

providing a pair of transparent or translucent glass lites;

spacing apart the glass lites from one another to define a gap therebetween;

forming a glazing panel by placing a rigid structural spacer in the gap and attaching the spacer to said lites, the spacer being placed such that the spacer extends around at least a portion of the periphery of said glass lites;

providing an interlocking profile on an exposed surface of the rigid structural spacer of the glazing panel to form a self-supported glazing panel, the interlocking profile being capable of mating with a complementary interlocking profile of a second structural spacer;

sizing the rigid structural spacer to by approximately 2" thick to maintain structural integrity to the glazing panel to form a self-supported, frameless glazing panel which can be inserted as a structural member in a wall or roof without use of a separate structural frame.

* * * * *